US010123635B2

(12) United States Patent
Lilja

(10) Patent No.: US 10,123,635 B2
(45) Date of Patent: Nov. 13, 2018

(54) SHELF WITH AUTOMATICALLY ERECTING SUPPORT STRUCTURE

(71) Applicant: Menasha Corporation, Neenah, WI (US)

(72) Inventor: Chad Michael Lilja, Farmington, MN (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 15/672,834

(22) Filed: Aug. 9, 2017

(65) Prior Publication Data

US 2018/0042405 A1 Feb. 15, 2018

Related U.S. Application Data

(60) Provisional application No. 62/372,923, filed on Aug. 10, 2016.

(51) Int. Cl.

| | |
|---|---|
| ***A47G 29/08*** | (2006.01) |
| ***A47F 5/00*** | (2006.01) |
| ***A47F 5/11*** | (2006.01) |
| ***B65D 5/52*** | (2006.01) |
| ***A47B 43/02*** | (2006.01) |

(Continued)

(52) U.S. Cl.

CPC ..... *A47F 5/116* (2013.01); *A47B 43/02* (2013.01); *A47B 47/06* (2013.01); *A47B 55/06* (2013.01); *B65D 5/5016* (2013.01); *B65D 5/5206* (2013.01); *B65D 5/5273* (2013.01)

(58) Field of Classification Search

CPC .. A47F 5/11; A47F 5/112; A47F 5/116; A47F 5/114; A47F 5/118; A47B 43/02; A47B 47/06; A47B 55/06; A47B 61/06; A47B 2220/0083; A47B 2220/0086; B65D 5/02; B65D 5/18; B65D 5/20; B65D 5/2009; B65D 5/2095; B65D 5/22; B65D 5/26; B65D 5/28; B65D 5/42; B65D 5/50; B65D 5/5002; B65D 5/5007; B65D 5/5016; B65D 5/5021; B65D 5/5023; B65D 5/36;

(Continued)

(56) References Cited

U.S. PATENT DOCUMENTS 2,150,743 A * 3/1939 Mancuso ..... G09F 5/00 211/135
2,884,179 A * 4/1959 Rossum ..... B65D 5/48004 229/120.14

(Continued)

FOREIGN PATENT DOCUMENTS

DE 102006043829 A1 * 3/2008 ..... A47F 5/116
DE 102006043829 A1 * 3/2008 ..... A47F 5/116

(Continued)

*Primary Examiner* — Jennifer E. Novosad

(74) *Attorney, Agent, or Firm* — Greensfelder, Hemker & Gale, P.C.

(57) ABSTRACT

A shelving display system having a support structure that automatically moves into place when setting up the display. The support structure includes a shelf support panel that includes a portion glued to the back panel and a plurality of shelf bottom support braces that extend from the back panel and are glued to the front panel. Opening the glued system from a flat folded state to a useable state automatically causes the support structure move partially or completely into place.

22 Claims, 14 Drawing Sheets

(51) Int. Cl.
*A47B 47/06* (2006.01)
*A47B 55/06* (2006.01)
*B65D 5/50* (2006.01)

(58) Field of Classification Search
CPC .. B65D 5/3607; B65D 5/3614; B65D 5/3621; B65D 5/3635; B65D 5/3685
USPC ..... 211/72, 73, 135; 108/165; 248/152, 154, 248/174, 300; 229/117.07, 117.01, 229/120.02, 120.08, 120.18, 120.24
See application file for complete search history.

(56) References Cited

U.S. PATENT DOCUMENTS 3,514,031 A * 5/1970 Burgess ..... B65D 5/4802 229/120.08
3,889,867 A * 6/1975 Berg ..... B65D 5/3621 206/431
4,311,100 A * 1/1982 Gardner ..... A47F 5/116 108/165
4,618,115 A * 10/1986 Belokin, Jr. ..... A47F 5/116 211/135
4,899,929 A 2/1990 Grollman
5,141,105 A * 8/1992 Maye ..... A47F 1/08 211/135
5,183,166 A * 2/1993 Belokin, Jr. ..... A47F 5/116 211/130.1
5,213,220 A * 5/1993 McBride ..... A47B 43/00 211/126.16
5,315,936 A * 5/1994 Smith ..... A47F 5/116 108/165
5,335,593 A * 8/1994 Stoddard ..... A47F 5/116 100/165
5,443,168 A * 8/1995 Dyment ..... A47F 5/116 211/149
5,458,411 A * 10/1995 Moss ..... A47B 47/06 312/259
5,826,732 A * 10/1998 Ragsdale ..... A47F 5/116 108/165
6,360,465 B1 3/2002 Simpson
7,007,615 B2 3/2006 Grueneberg
7,703,864 B2 * 4/2010 Moser ..... B65D 5/5213 206/747
8,157,112 B2 * 4/2012 Bojie ..... A47F 5/11 211/135
8,485,370 B2 * 7/2013 Dewhurst ..... A47F 5/116 211/135
8,857,633 B2 10/2014 Dewhurst
9,045,250 B2 6/2015 Henderson et al.
9,211,021 B2 * 12/2015 Smith ..... A47F 5/116
9,428,298 B2 8/2016 Bersamin et al.
9,487,321 B2 * 11/2016 Luke ..... A47F 5/116
9,743,783 B1 * 8/2017 Bersamin ..... A47F 5/116
9,907,414 B2 3/2018 Heuer
9,918,569 B1 3/2018 Abel
9,919,829 B2 3/2018 Jolley
9,938,040 B2 4/2018 Buscema
9,969,523 B2 5/2018 Ayerst
2007/0272639 A1 * 11/2007 Alexander ..... A47F 5/10 211/186
2012/0305512 A1 * 12/2012 L'Hotel ..... A47F 5/116 211/198
2017/0079449 A1 3/2017 Smith
2018/0070747 A1 3/2018 Smith
2018/0092461 A1 4/2018 Brady et al.
2018/0130382 A1 5/2018 Hinch et al.

FOREIGN PATENT DOCUMENTS

DE 102011116238 A1 * 2/2011 ..... A47F 5/116
DE 102011116238 A1 * 4/2013 ..... B65D 5/52
FR 2984705 A3 * 12/2011 ..... A47F 5/116
FR 2984705 A3 * 6/2013 ..... A47F 5/116
WO WO-2008127499 A1 * 10/2008 ..... A47F 5/116

* cited by examiner

SHELF WITH AUTOMATICALLY ERECTING SUPPORT STRUCTURE

CROSS-REFERENCE TO RELATED APPLICATIONS

The present invention claims the benefit of U.S. Provisional Application No. 62/372,923, filed Aug. 10, 2016, the contents of which are incorporated herein by reference.

FEDERALLY SPONSORED RESEARCH OR DEVELOPMENT

N/A

FIELD OF THE INVENTION

The present invention is generally directed to shelving systems formed from corrugated paper or other similar materials having support structure that automatically moves into position during assembly.

DESCRIPTION OF THE PRIOR ART

Displays are used in retail for presenting goods. Many such displays are made of corrugated paper or other similar materials, and are set up at the retail location.

In the past, such displays often consisted of more than one piece of material that needed to be glued together. Those assembling the displays were required to perform a number of manual operations. For example, an assembler would have to secure the shelving inside the display. This operation would need to be performed multiple times if the display contained more than one shelf.

The present invention provides an improved display design that limits the number of operations needed to assemble the display at the retail site.

SUMMARY OF THE INVENTION

The present invention discloses a display that is easily assembled. The display can be formed from a single piece of corrugated material. The display includes shelving that is glued into the structure through one machine process. The display will fold and the components will lock into place automatically when the body of the display is squared.

In accordance with one aspect of the present invention, an easily assembled shelf display configured to automatically erect a support structure is provided. The shelf display system comprises a front panel having a plurality of shelves pivotally connected to the front panel, a first side panel connected to a first side of the front panel, a second side panel connected to a second side of the front panel, and a back panel. The system also comprise a shelf support panel having a plurality of shelf bottom support braces extending from the back panel to the front panel wherein each brace is aligned with one of the plurality of shelves.

The shelf support panel can include a back connection portion that is secured to the back panel. Preferably, the back connection portion is glued to an inner surface of the back panel.

The shelf bottom support braces can be foldably connected to the back connection portion of the support panel. Additionally, a plurality of front connection panels can be connected to a front end of the bottom support braces. Each front connection panel connects one of the plurality of shelf bottom support panels to an inner surface of the front panel. The front connection panels can be glued to the front panel.

Each of the plurality of shelf bottom support panels cab be connected to a pivot portion. In turn, each of the plurality of pivot portions can be connected to a shelf connection portion. Each shelf connection portion can be connected to a bottom surface of one of the plurality of shelves. According to one aspect of the invention, each shelf connection portion is glued to the bottom surface of the one of the plurality of shelves.

The main panels of the shelf display, that is, the front panel, first side panel, second side panel, back panel and shelf support panel can be formed from a single blank of material. The material can corrugated paper, corrugated plastic or other suitable materials.

The back connection portion can include a plurality of slots. Each of the plurality of shelves can include an upper tab or extension configured to be secured in one of the plurality of slots when the display is set up.

The shelf display can further comprise a plurality of top flaps. The top flaps can be folded to form a top wall of the display.

In accordance with another aspect of the invention, an easily assembled shelving system is provided wherein the components of the system are integrally connected to each other by fold lines formed in the display system material. The shelving system comprises a front panel having a plurality of shelves foldably connected to the front panel at a front edge of each shelf, a first side panel connected to a first side of the front panel by a fold line, a second side panel connected to a second side of the front panel by a fold line, and a back panel connected to the second side panel by a fold line. The system further comprises a shelf support panel having a plurality of shelf bottom support braces extending from the back panel to the front panel. Each brace is positioned vertically when the system is set up. Each brace is aligned to support one of the plurality of shelves.

The shelf support panel is connected to the first side panel by a fold line. The shelf support panel can be glued to an inner surface of the back wall.

The shelving system can further comprise a plurality of front connection panels. Each front connection panel can be connected to one of the plurality of shelf bottom support braces by a fold line. Additionally, each front connection panel can connect the one of the plurality of shelf bottom support braces to an inner surface of the front panel. The front connection panels can be glued to an inner surface of the front panel.

Each of the shelf bottom support braces can be connected to a pivot portion by a fold line. Similarly, each pivot portion can be connected to a shelf connection portion by a fold line.

The shelves can include a shelf extension projecting from a back edge of the shelf. The shelf extension can be configured to fold against the back panel when the system is set-up and fit against an edge of the back connection portion.

Each of the shelf bottom support braces can be connected to a first pivot portion by a fold line. Each first pivot portion can be connected to a second pivot portion by a fold line. Each second pivot portion can be connected to a shelf connection portion by a fold line. The first and second pivot portions can fold against each when the shelf is pushed into place.

Further aspects of the invention are shown in the Figures and described herein.

BRIEF DESCRIPTION OF THE DRAWINGS

To understand the present invention, it will now be described by way of example, with reference to the accompanying drawings in which.

DETAILED DESCRIPTION

Figure 1:
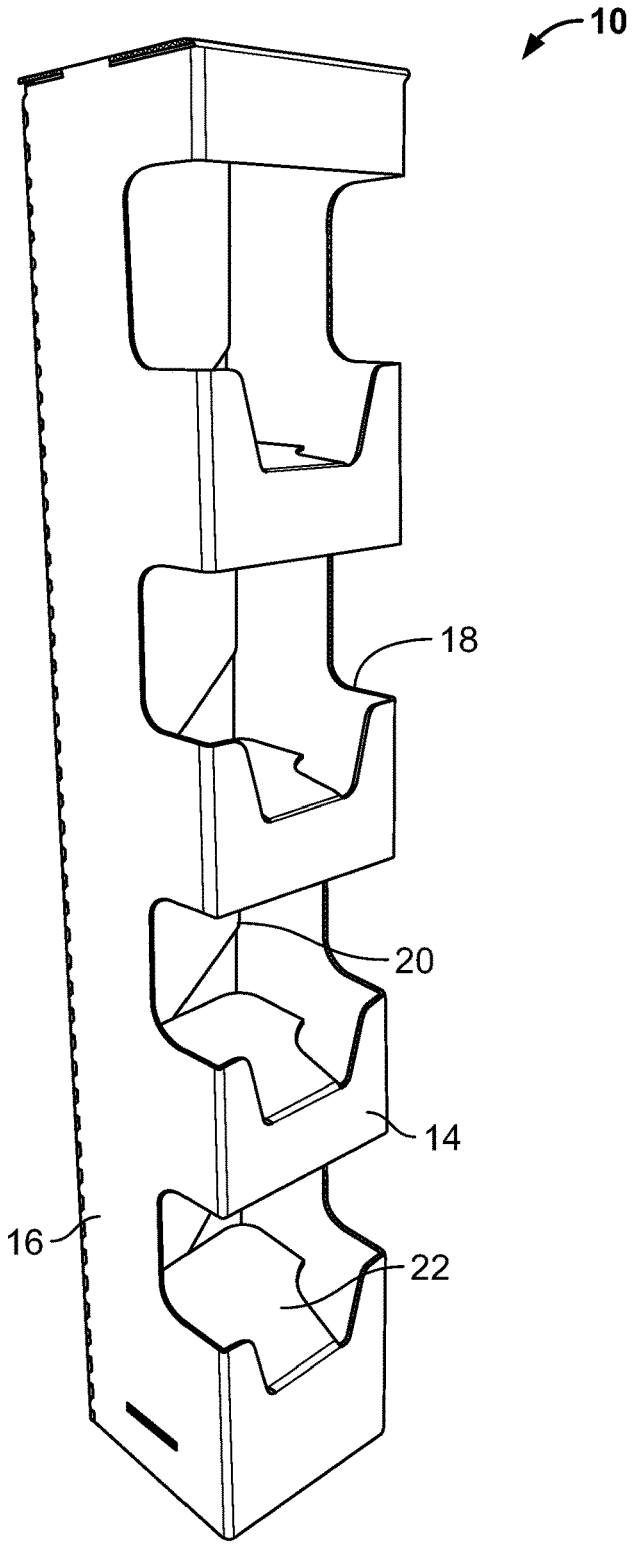
FIG. 1 is a perspective view of an erected auto shelf system in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
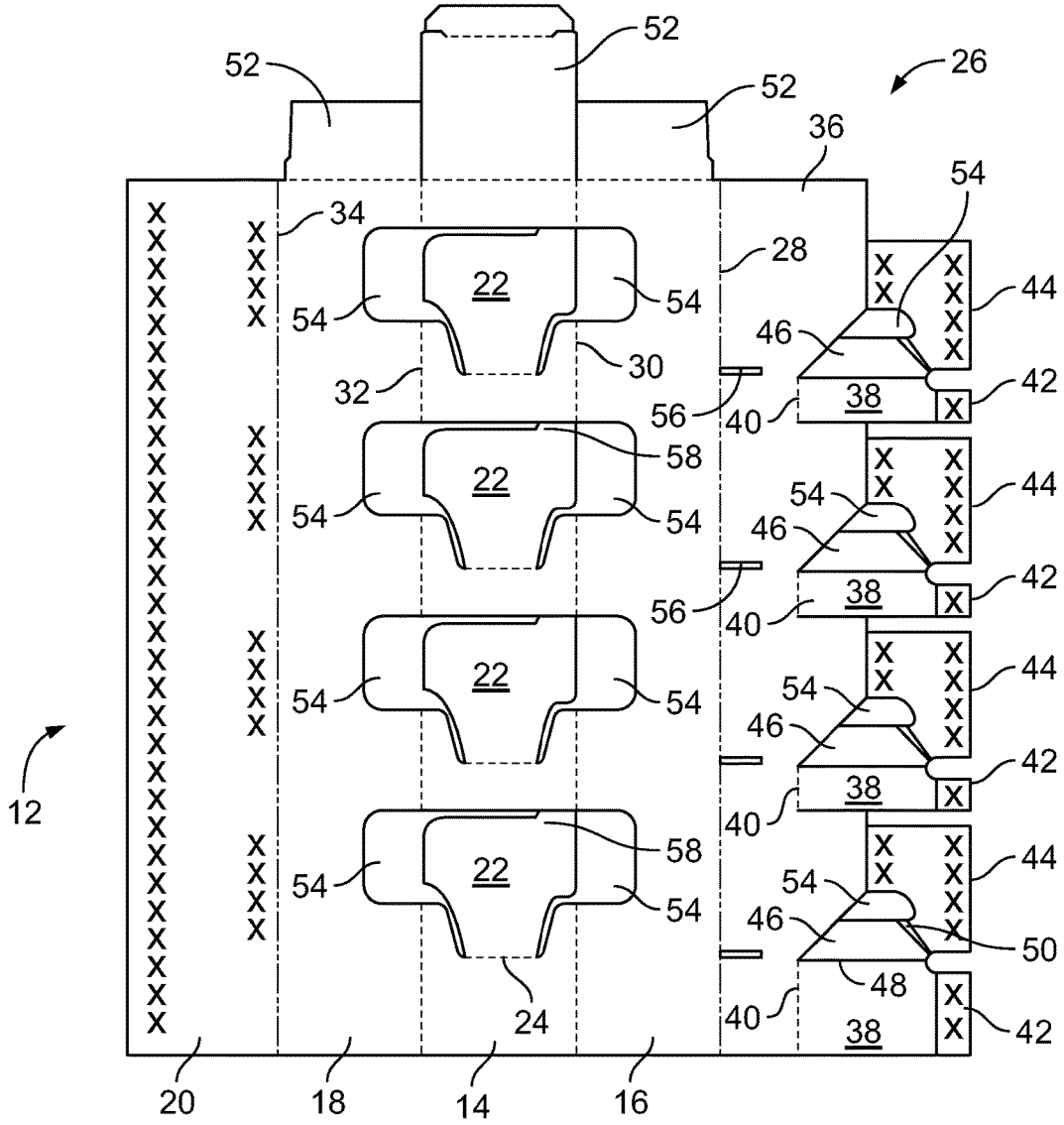
FIG. 2 is a top plan view of a blank of material for forming the auto shelf system of FIG. 1.

FIGS. 1 and 2 show, respectively, a shelf display system 10 and a blank 12 for forming the shelf display system 10. The blank 12 is a single contiguous piece of material that is cut and scored and/or provided fold lines to enable it to fold into the shelf display system when set up. Additionally, glue may be used to facilitate construction of the system. "X"'s on the blank designate preferred areas for glue. The blank 12 can be formed from a corrugated paper material, a corrugated plastic material, or other similar suitable material.

The fully set up shelf display system 10, shown in FIG. 1, includes a front wall or panel 14, a first side wall or panel 16 connected at a first side of the front wall 14, a second side wall or panel 18 connected to a second side of the front wall 14 and a back wall or panel 20 (although not evident in FIG. 1, the back wall 20 is connected to the second side wall 18 as more clearly illustrated in FIG. 2). The display system 10 also includes a plurality of shelves 22. Each shelf 22 is foldably connected at a front edge 24 of the shelf 22 to the front wall 14.

Although not shown in FIG. 1, the shelf display system 10 includes structure which facilitates quick set up of the system 10 and provides support for the shelves 22. The support structure is part of a support wall or panel 26 illustrated on the blank 12 of FIG. 2.

As shown in FIG. 2, the blank 12 is a single piece of material that can be formed in a die cutting operation. The support panel 26 is connected by a fold line 28 to one side of the first side wall 16. The first side wall 16 is connected at an opposing side to one side of the front wall 14 by a fold line 30. The front wall 14 is connected at an opposing side to one side of the second side wall by a fold line 32. Finally, the second side wall 18 is connected at an opposing side to one side of the back wall 20 by a fold line 34.

The support panel 26 includes a back connection portion 36 and a plurality of structures for connecting to and supporting the shelves 22. FIG. 2 shows the inwardly or inner facing surfaces of the various walls 14, 16, 18, 20 and back connection portion 36. In operation, an outer surface of the back connection portion 36 is adhered to an inner surface of the back wall 20 by glue (again, designated by "X"s) placed on the back wall (alternatively, glue could be placed on the outer surface of the back connection portion 36, or on both the inner surface of the back wall 20 and the outer surface of the back connection portion 36).

The structures for connecting to and supporting the shelves 22 include a plurality of shelf bottom support braces or panels 38 that are connected at one end to the back connection portion 36 by fold lines 40. Each shelf bottom support panel 38 is aligned to support one of the shelves 22. The shelf bottom support panels 38 include front connection portions 42 at an opposing end. In operation, the shelf bottom support panels 38 are folded on the fold line 40 and the front connection portions are glued to an inner surface of the front wall 14 (again, while glue is shown on the front connection portions 42, it may be placed on the inner surface of the front wall 14 or both). The back connection portion 36 is sized and positioned so that each shelf bottom support panel 38 extends vertically along the bottom of a respective shelf 22 approximately along the middle of the shelf 22 (as used herein, directional terms, e.g., vertical, right/left, top etc., are used with respect to the components and features as shown in the drawings and as typically positioned during use and are not meant to otherwise limit the invention).

Each of the structures for connecting to and supporting the shelves 22 also include a shelf connecting portion or panel 44 that is connected to the shelf bottom support panel 38 by a pivot panel or portion 46. As shown in FIG. 2, the shelf connecting panel 44 includes glue for adhering to the bottom surface of the shelf 22 (again, the glue could alternatively be applied to the bottom surface of the shelf or both).

Figure 5:
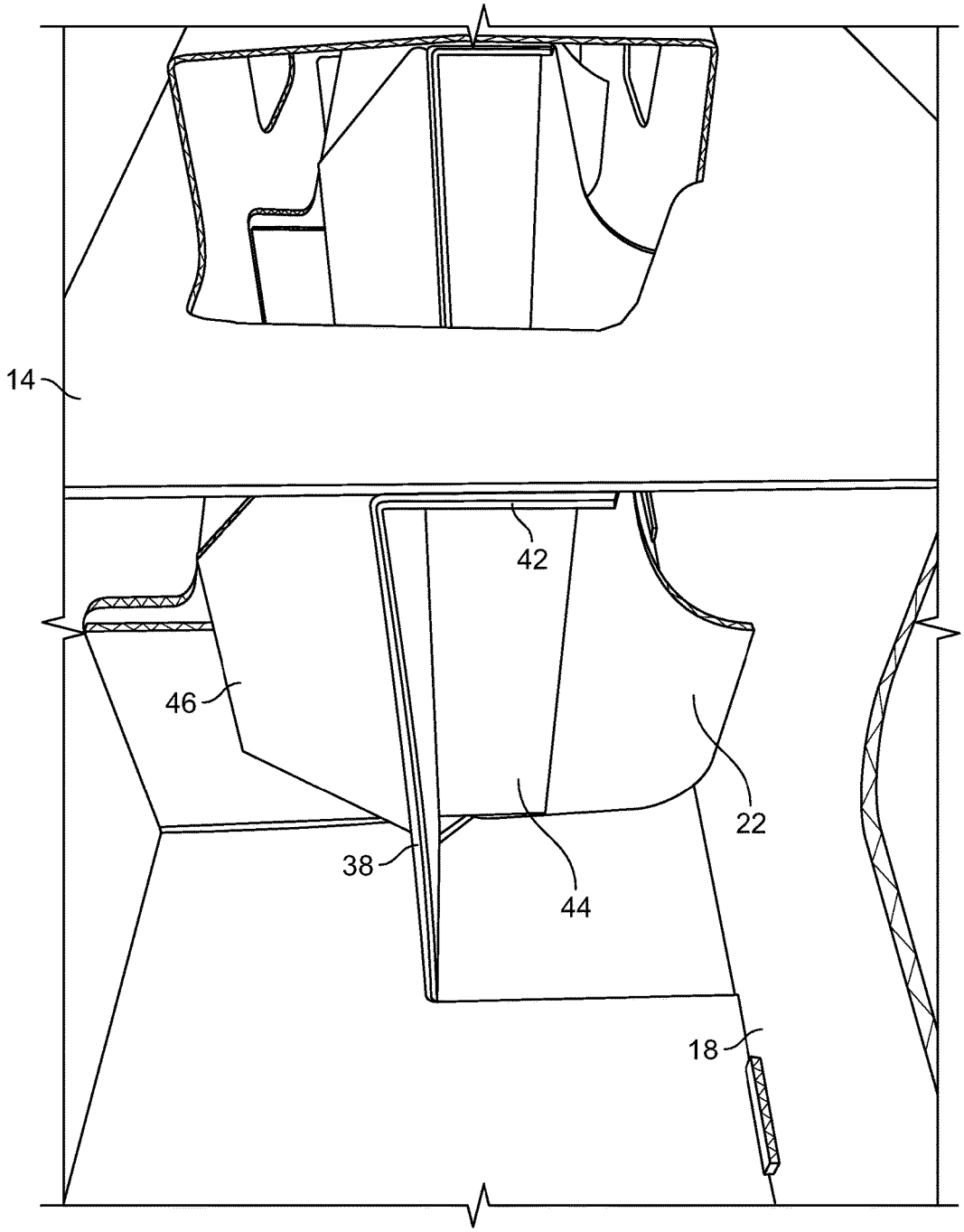
FIG. 5 is a bottom perspective view of a shelf and a shelf support structure of a shelf system in accordance with the blank of FIG. 2.

The pivot portion 46 is connected to the shelf bottom support panel 38 by a fold line 48. The fold line 48 allows the pivot portion 46 to pivot to a horizontal position when the system is set up. The pivot portion 46 includes another fold line 50 connecting it to the shelf connection portion 44. FIG. 5 shows the positioning of the shelf connecting panel 44, pivot portion 46 and bottom support panel 38 when the shelf is properly positioned for use in the system 10.

Figure 3:
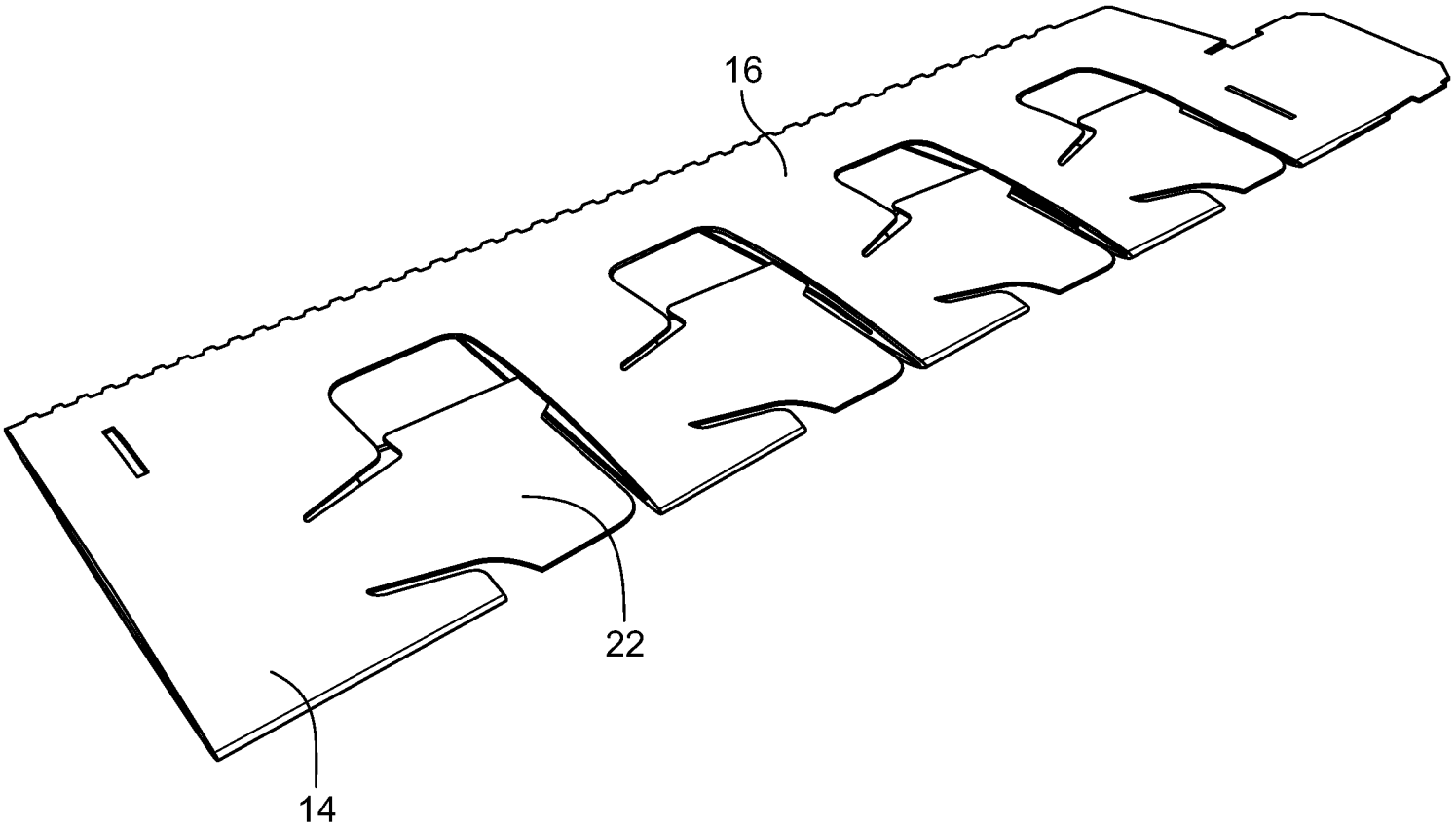
FIG. 3 is a perspective view of the shelf system in accordance with the blank of FIG. 2 glued and folded to a flat configuration.
Figure 4:
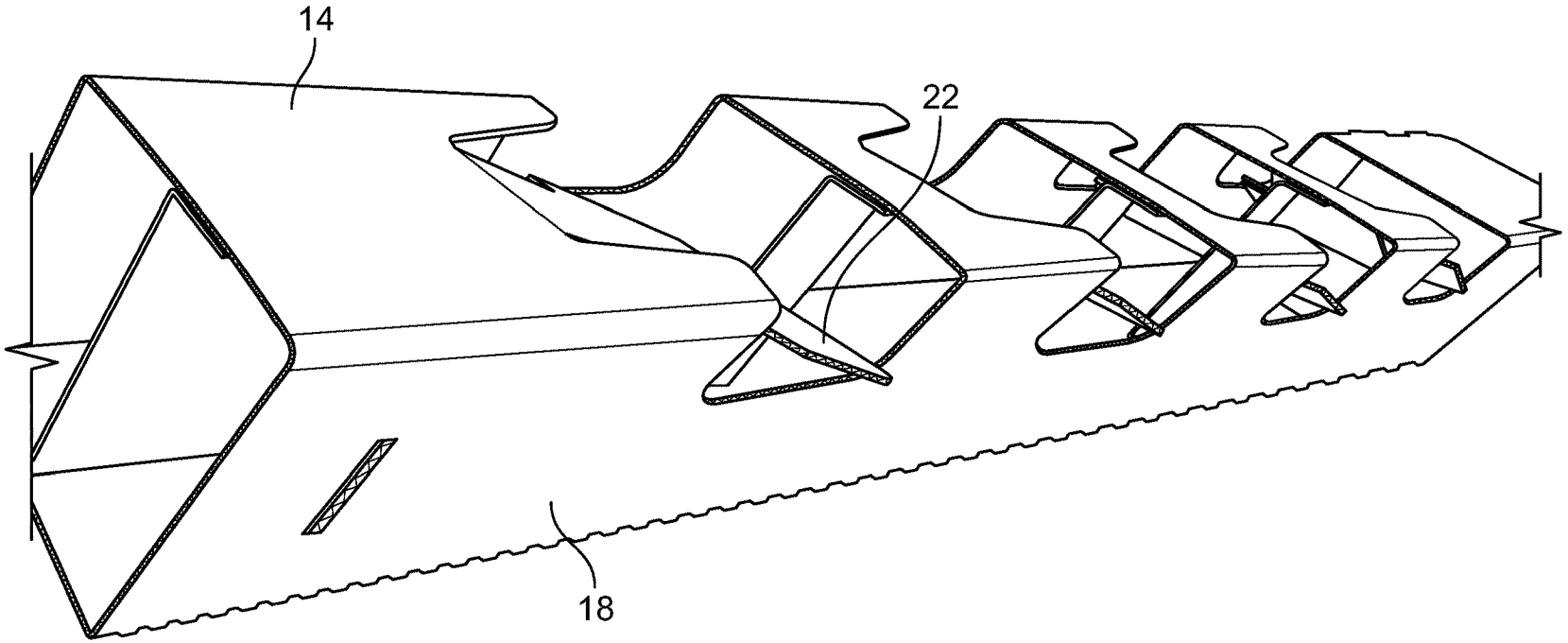
FIG. 4 is a perspective view of the shelf system of FIG. 3 partially squared by an assembler.
Figure 6:
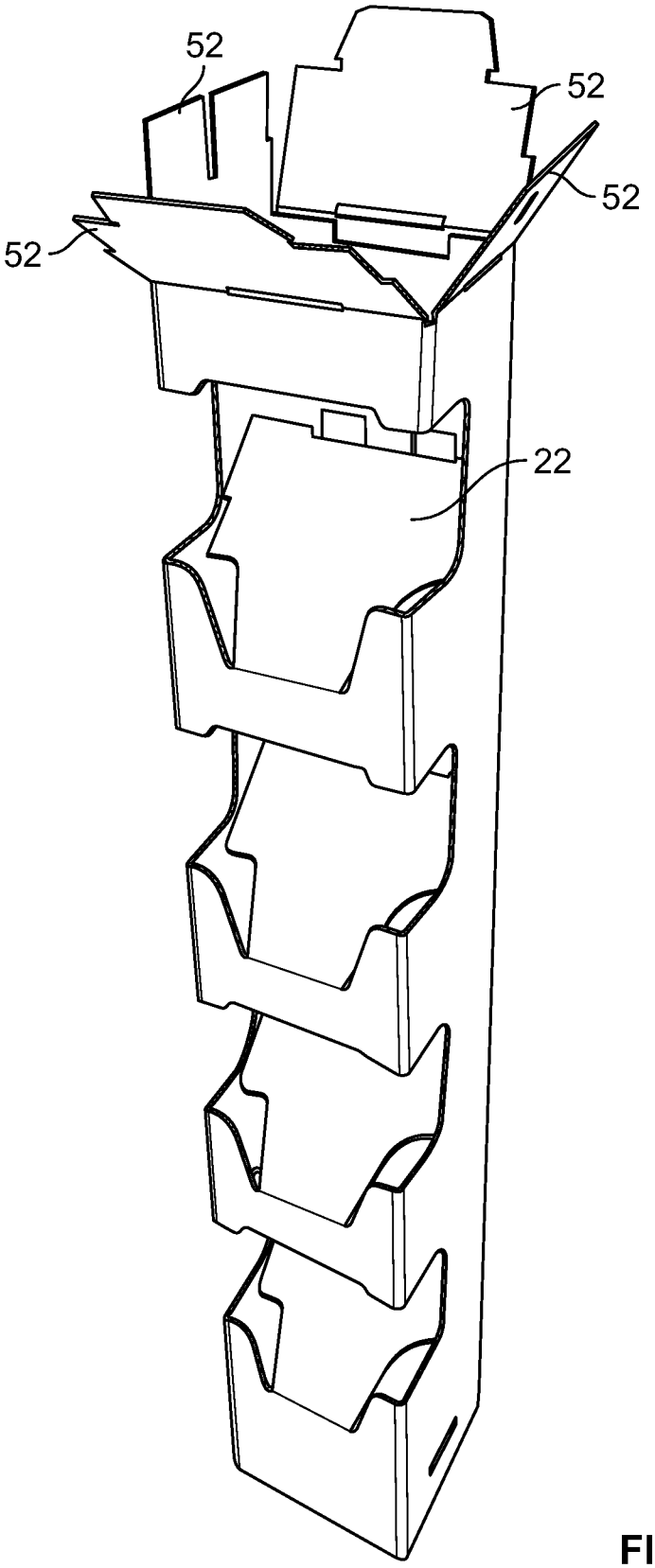
FIG. 6 is a perspective view of a shelf system prior to folding the shelves into place.
Figure 7:
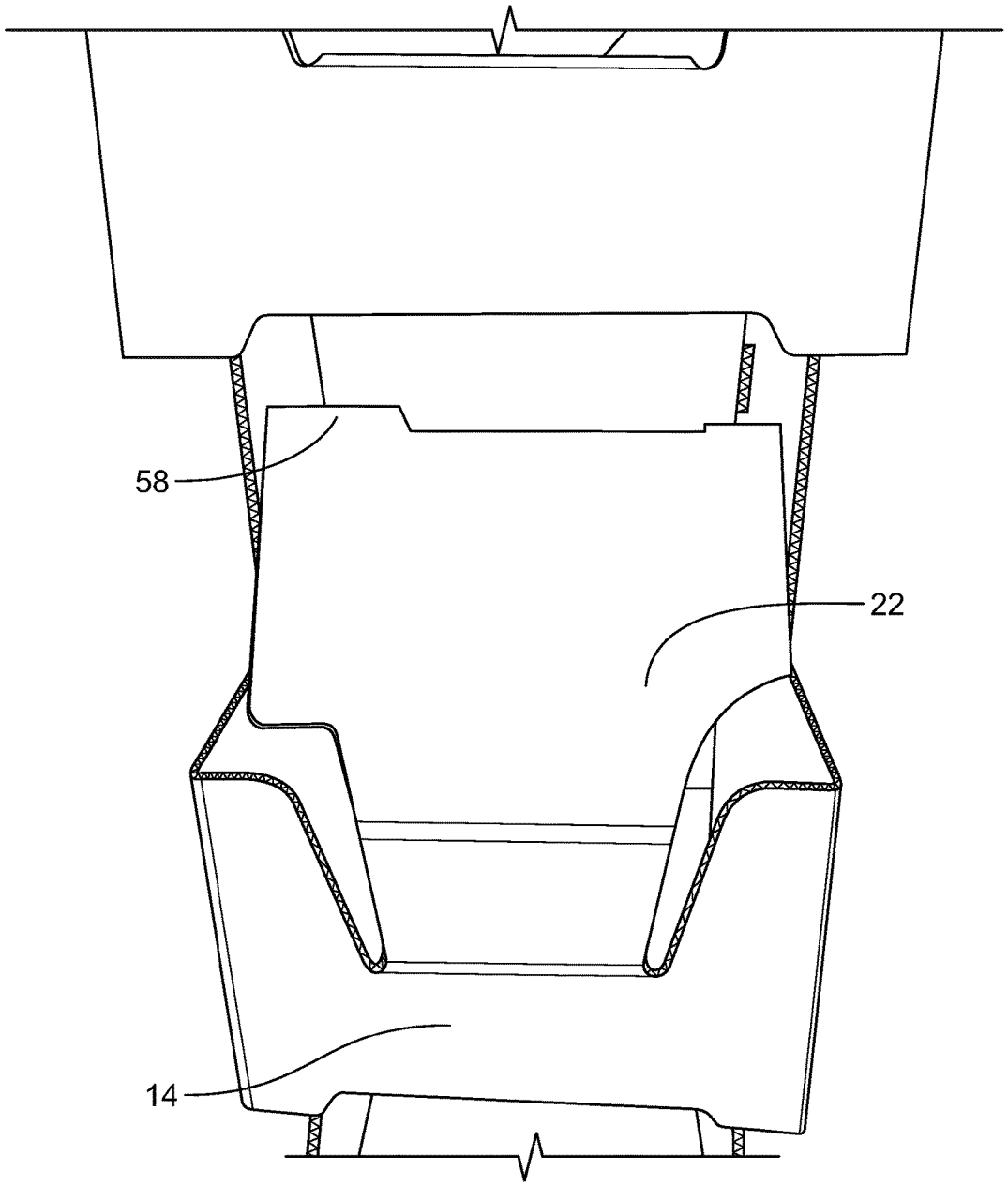
FIG. 7 is a front perspective view of a shelf of the shelf system prior to being folded into place.
Figure 8:
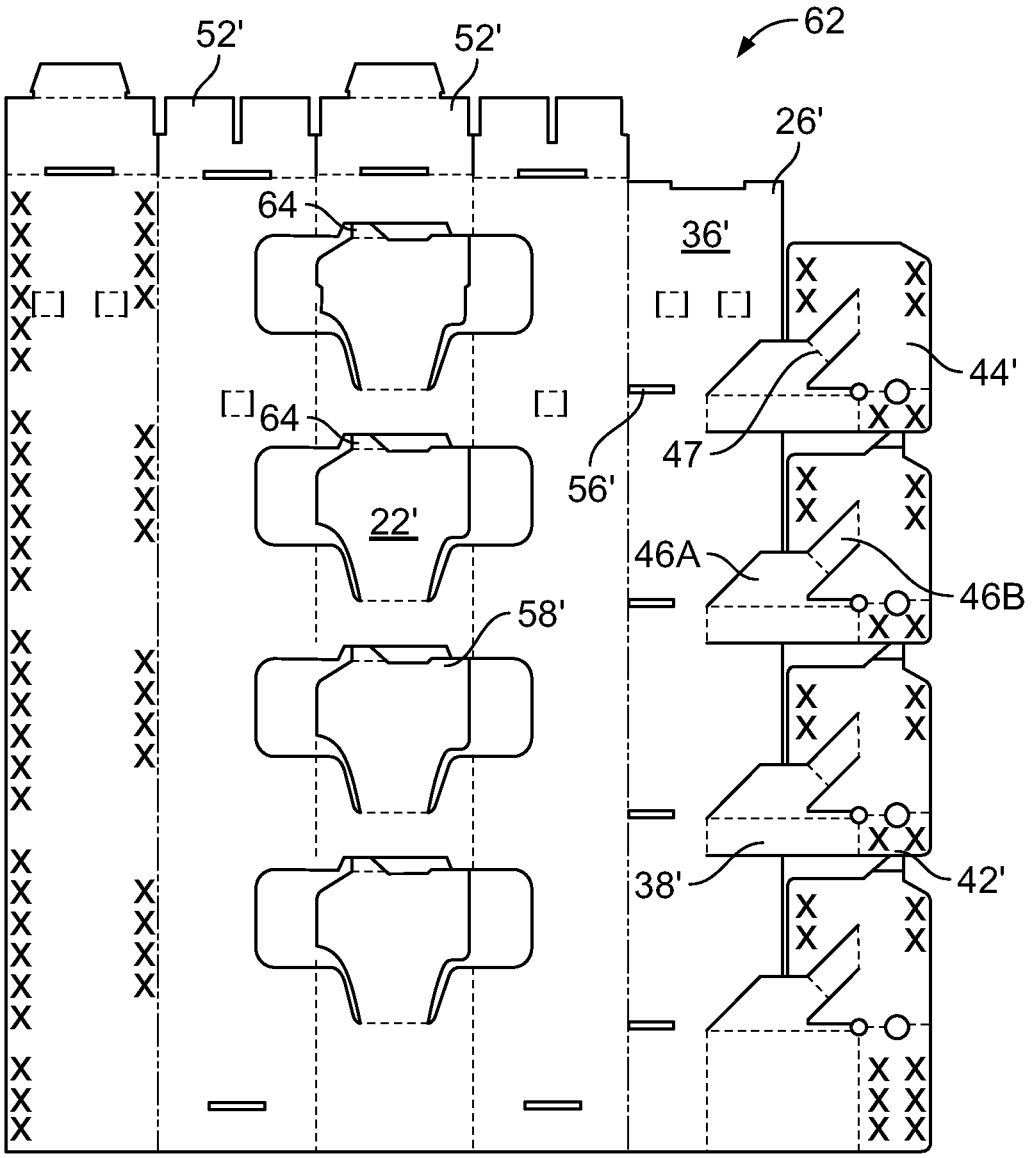
FIG. 8 is a top plan view of a blank of material for forming another aspect of the auto shelf system.

Prior to being shipped, all of the gluing is performed. However, while glued, the shelf system 10 can be folded flat as shown in FIG. 3, and thus take up less room during transport. To set up, the folded walls of the system 10 are squared (i.e., moved toward having right angles or corners) as illustrated in FIG. 4. Because they are glued to the front wall 14 by the front connection portions 42, this squaring action causes the bottom support panels 38 to automatically move to the proper shelf support position. At this stage the shelves 22 are partially folded inwardly as shown in FIGS. 6 and 7. The shelves 22 can then be easily pushed down to obtain the final configuration shown in FIG. 1.

As illustrated in FIG. 2, the blank 12 includes a number of openings that can be cut away during the die the cutting process. Additionally, a number of slots 56 can be cut from the back connection portion 36. The slots 56 can be used with tabs 58 formed in the shelves 22 to provide a more secure fit.

While glue is used for portions of the display 10, other means can be used for connecting portions of the display to each other. For example, Velcro or other structural of mechanical mechanisms can be used.

The shelf system 10 can include top flaps 52 for folding into a top wall. Similarly, the system can include bottom flaps to form a bottom wall.

The bottom portion of each of the front panel, first and second side panels, and back panel form a base for supporting the shelving system 10. Various configurations or additional structures can be implemented to provide a more secure base if necessary. Additionally, bottom flaps can be added to form a bottom wall for the system 10.

Figure 9:
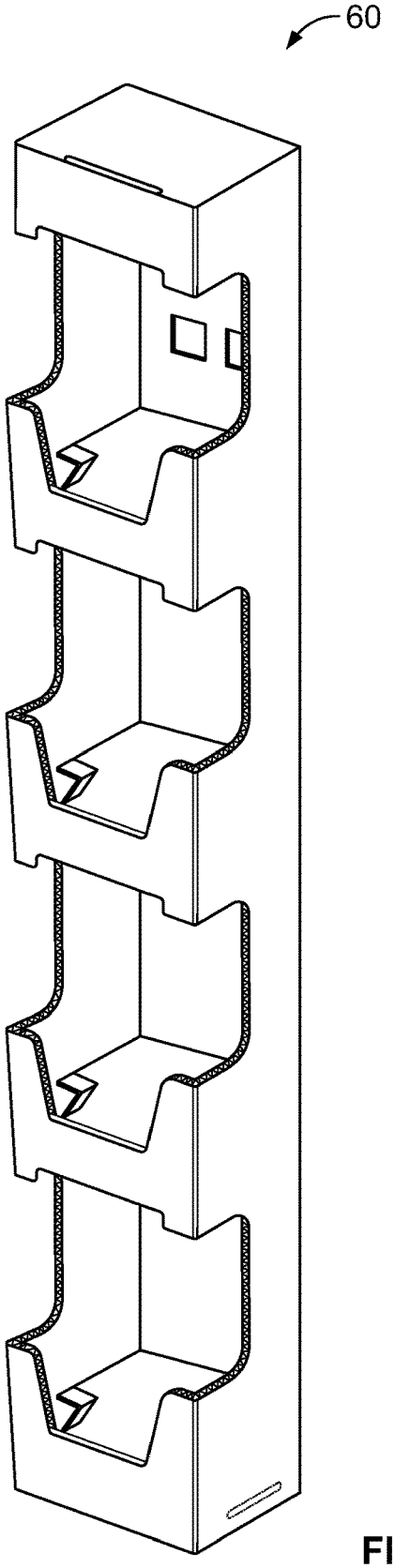
FIG. 9 is a perspective view of an auto shelf system in accordance with the blank of FIG. 8.

FIGS. 8-14 show another aspect of the present invention. FIG. 9 shows a set-up shelf system 60 made in accordance with a blank 62 shown in FIG. 8. The shelf system 60 of FIGS. 8-14 includes a number of identical or substantially similar features as that shown in the system 10 and blank 12 of FIGS. 1-7, as well as some additional features.

Figure 10:
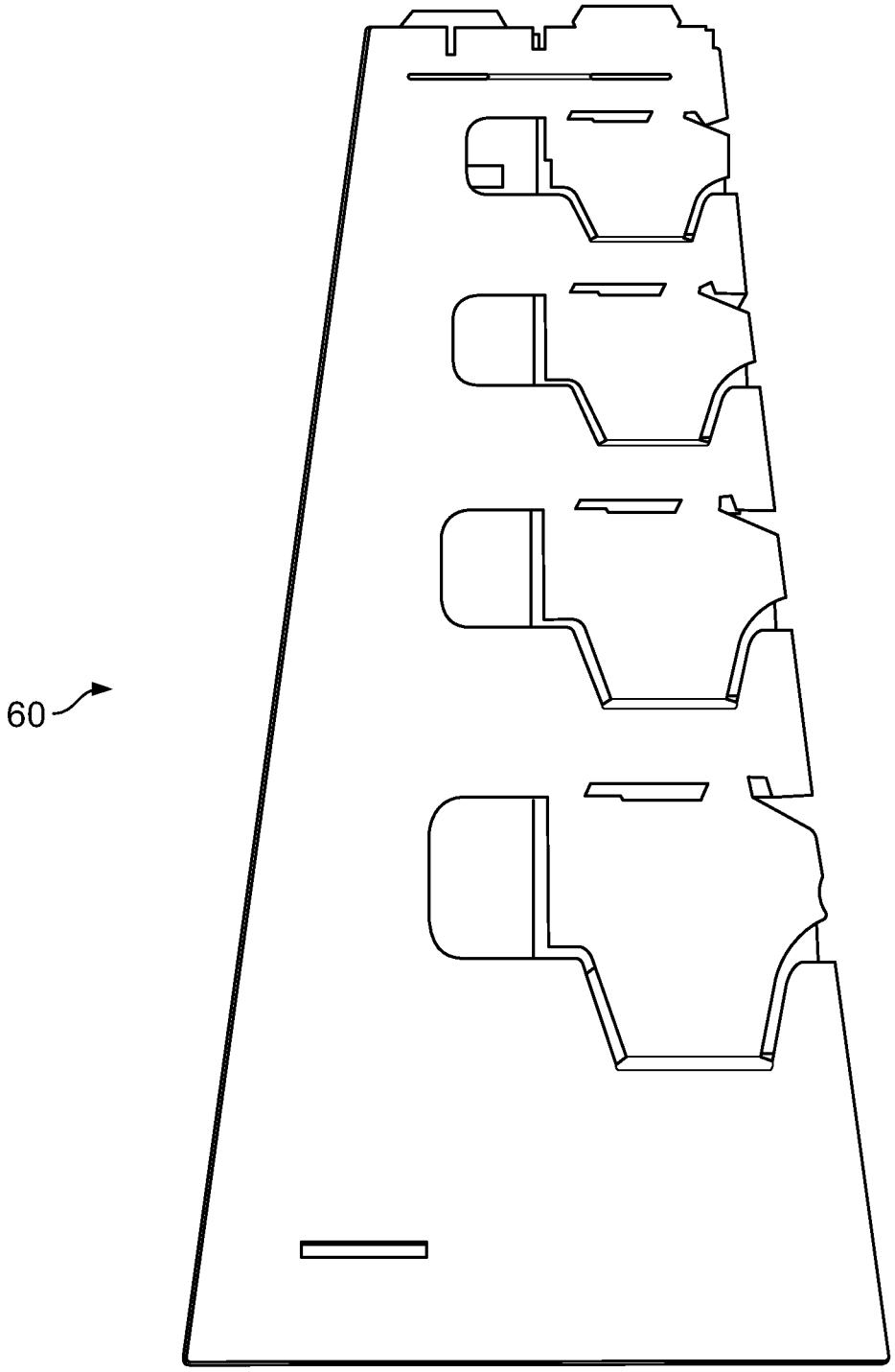
FIG. 10 is a perspective view of the shelf system in accordance with the blank of FIG. 8 glued and folded to a flat configuration.
Figure 11:
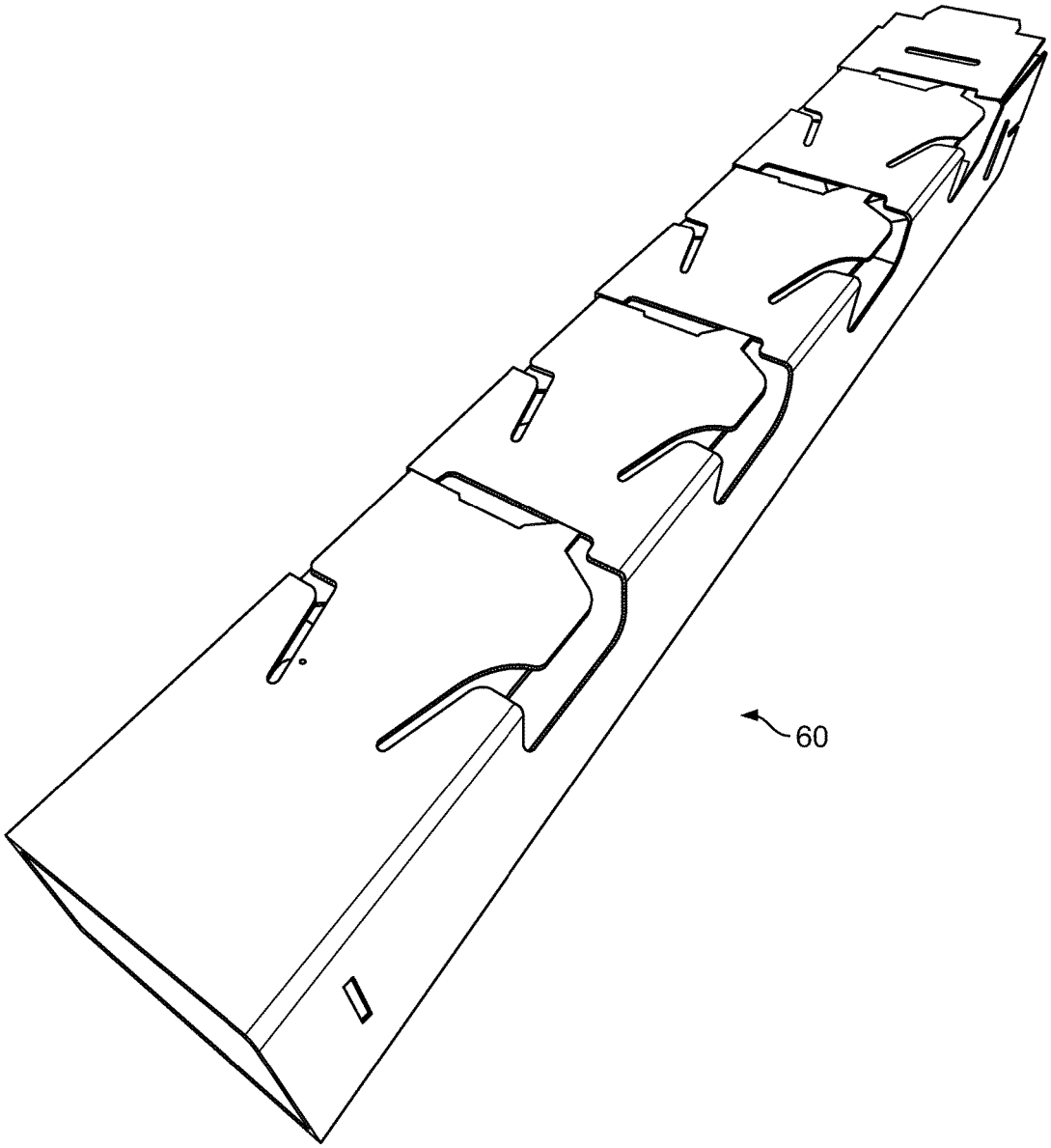
FIG. 11 is a perspective view of the shelf system of FIG. 10 squared by an assembler.

Similar to the system 10, the shelf system 60 of FIG. 9 can be glued and folded flat as shown in FIG. 10 prior to shipping. The walls of the system can then be squared as shown in FIG. 11.

As shown in the blank 62, the shelf system 60 includes a support panel 26' having a back connection portion 36' and a plurality of shelf support structures. The shelf support structures include a shelf bottom support brace 38' and a front connection portion 42'. Although shaped slightly different than the system 10 of FIGS. 1-7, the shelf support structures also include a shelf connecting portion or panel 44'. The structures also include a first pivot panel 46A connected to the bottom support brace 38', and a second pivot panel 46B connected to the first pivot panel 46A by a fold line 47.

The shelves 22' of the system 60 include tabs 58' along the top edge (i.e., the back of the shelf when set up) which cooperate with slots 56' in the support panel 26'. Additionally, the shelves 22' also include extensions 64 which prevent the shelf from popping up as explained below.

In operation, the shelf system 60 squares up the shelves 22' when the system 60 is opened (i.e., moved from a folded configuration of FIG. 10 to that of FIG. 11) but does not actually lock them into place. Instead, each shelf 22' must be pushed into place by an assembler. As each shelf 22' is pushed in to place, the shelf 22' automatically folds the pivot panels 46A and 46B to create, in part, the shelf support structure along with the bottom support brace 38' (the bottom support brace 38' which is connected to the front wall by the front connecting portion 42', automatically goes into position when the walls are unfolded).

Figure 12:
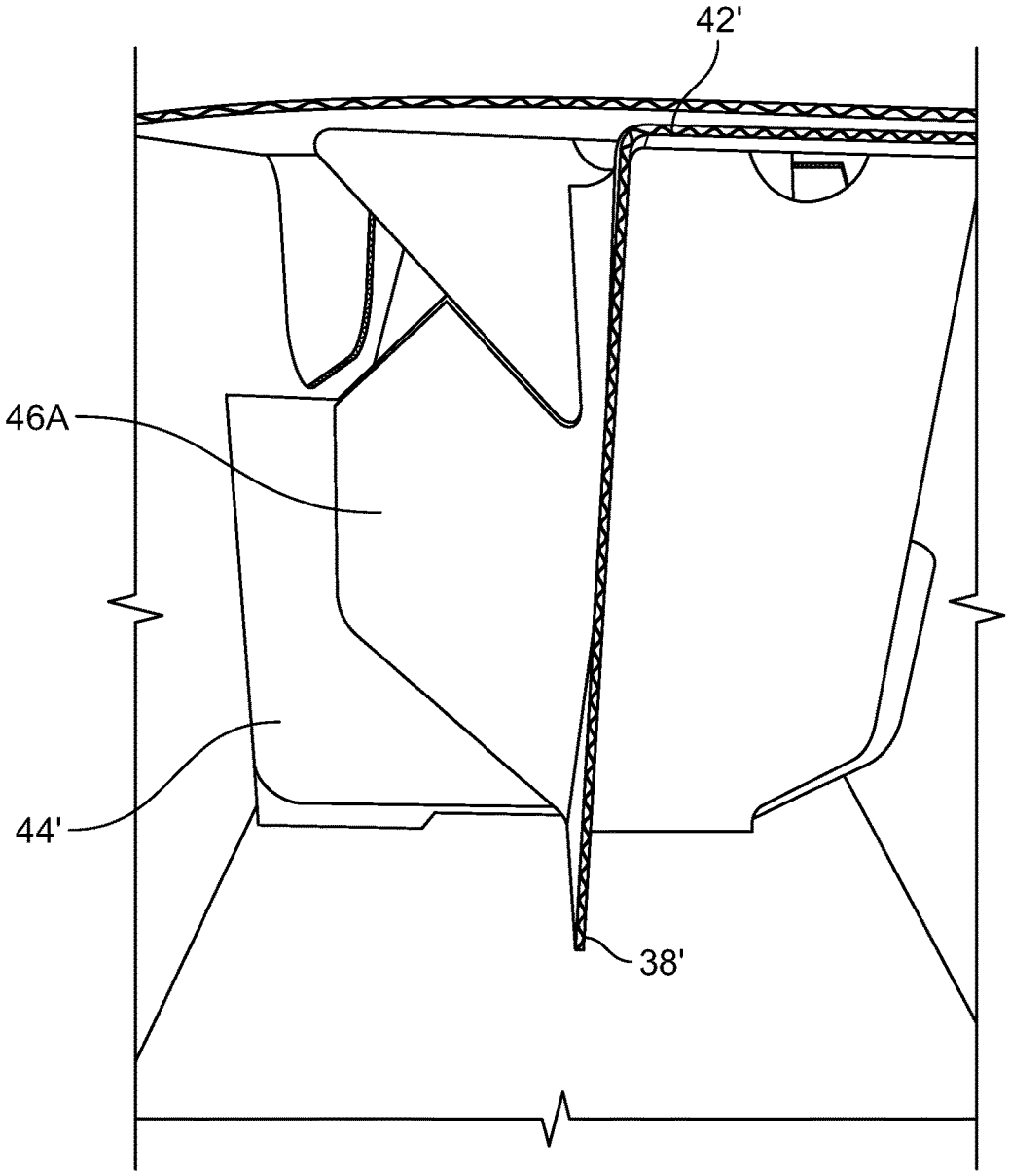
FIG. 12 is a bottom perspective view of a shelf and a shelf support structure of a shelf system in accordance with the blank of FIG. 8.

FIG. 12 shows the positioning of the bottom support brace 38' and front connection panel 42'. The pivot panel 46A (pivot panel 46B is not visible in this view) and shelf connecting portion 44' are also shown.

Similar to the system 10 of FIGS. 1-7, each shelf 22' locks into place on the left (when viewing the set-up system 60—the blank 62 view shows the inner surfaces of the various panels with the various features on the opposite side). That is, the tab 58' fits into a slot 56' on the back connection portion 36'. This helps prevent the shelf 22' from it from going down.

Figure 13:
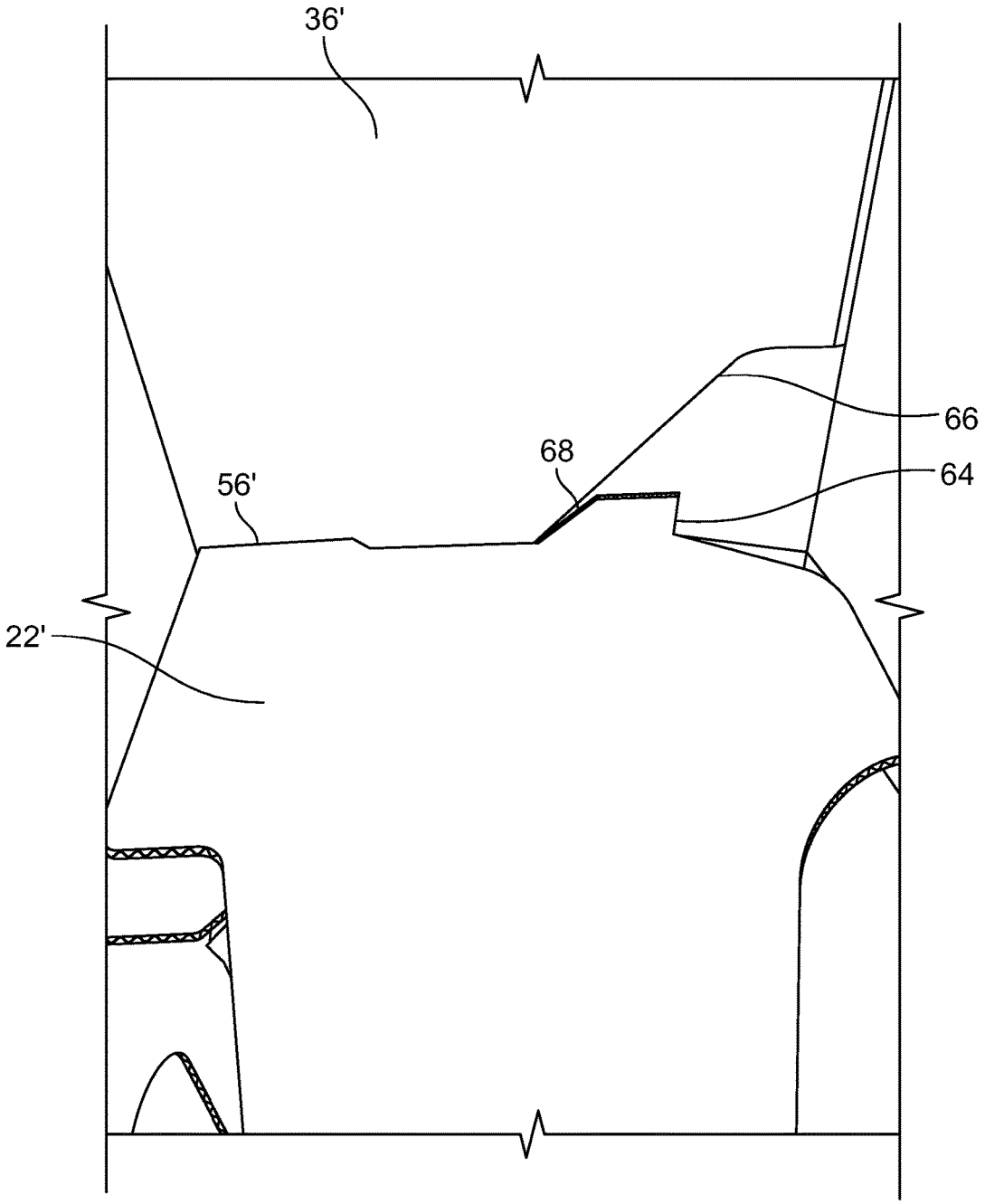
FIG. 13 is a perspective view of a shelf and back panel connection portion in accordance with the blank of FIG. 8; and, FIG. 14 is a perspective view of the auto shelf system in accordance with the blank of FIG. 8 with open top flaps.
Figure 14:
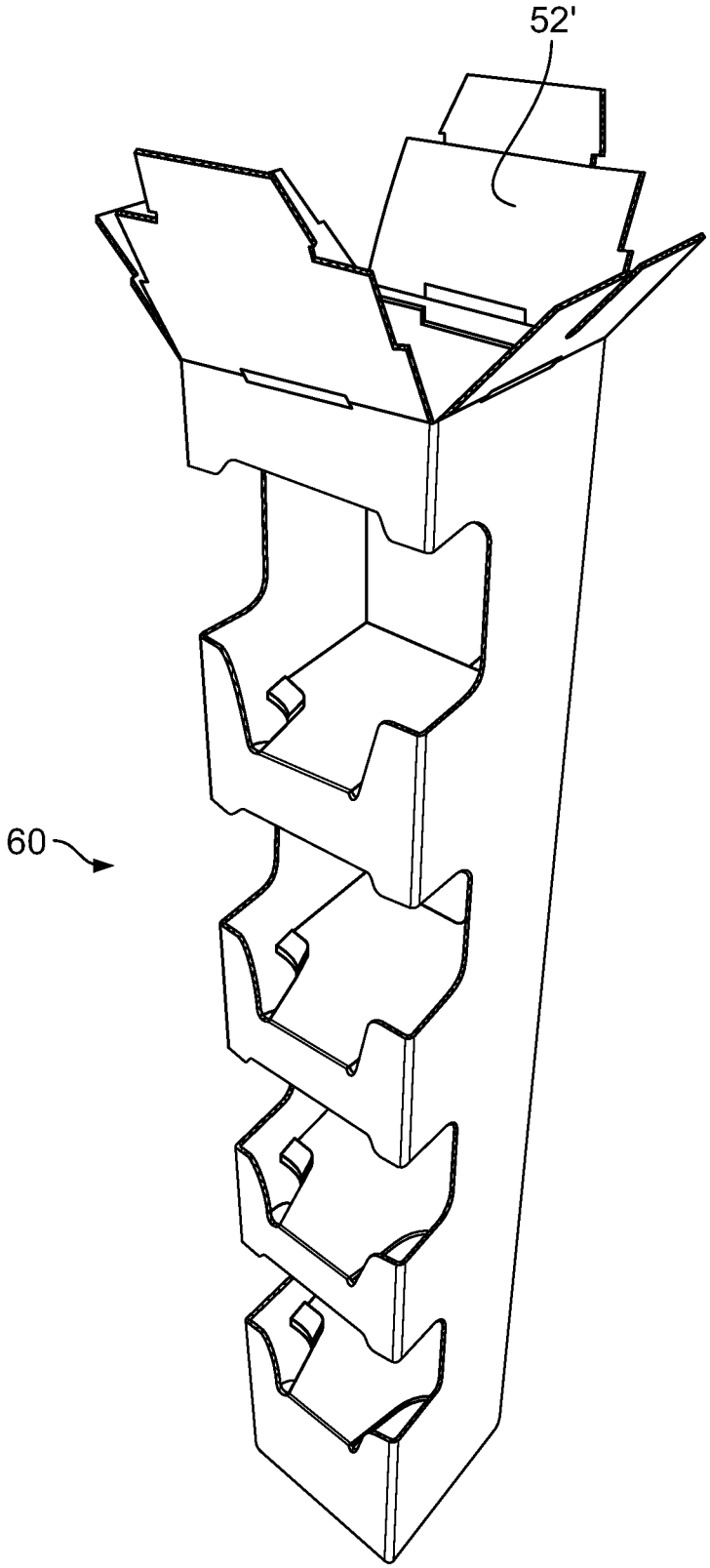

The shelves 22' also include an extension 64 on the right (at the back of the shelf 22') that prevents the shelf 22' from fully popping back up. When set up, the extension 64 contacts the back wall panel as the shelf 22' is pushed in, and bends or folds upward as illustrated in FIG. 13. The upwardly folded extension 64 fits in an groove formed by an edge 66 of the back connection portion 36'. The angle of the edge 66 of the back connection portion 36' matches the angle of an edge 68 of the extension 64 that contacts it.

The shelf system 60 also includes a plurality of upper flaps 52' that can be used to form a top wall of the system 60. Again, lower flaps or other structure can be incorporated into the bottom of the shelf system 60 to provide a bottom wall or a sturdier base portion.

Many modifications and variations of the present invention are possible in light of the above teachings. It is, therefore, to be understood within the scope of the appended claims the invention may be protected otherwise than as specifically described.

I claim:

1. A shelf display system comprising:

a front panel having a plurality of shelves pivotally connected to the front panel, a first side panel connected to a first side of the front panel, a second side panel connected to a second side of the front panel, and a back panel; and, a shelf support panel having a plurality of shelf bottom support braces extending from the back panel to the front panel wherein each brace is aligned with one of the plurality of shelves; and, a plurality of front connection panels wherein each front connection panel connects one of the plurality of shelf bottom support braces to an inner surface of the front panel.

2. The shelf display system of claim 1 wherein the support panel includes a back connection portion that is secured to the back panel.

3. The shelf display system of claim 2 wherein the back connection portion is glued to an inner surface of the back panel.

4. The shelf display system of claim 2 wherein the shelf bottom support braces are foldably connected to the back connection portion of the support panel.

5. The shelf display system of claim 2 wherein the back connection portion includes a plurality of slots and wherein each of the plurality of shelves includes an upper tab configured to be secured in one of the plurality of slots.

6. The shelf display system of claim 2 further comprising a back shelf extension configured to fold against the back panel when the shelf display system is set up and to fit against an edge of the back connection portion.

7. The shelf display system of claim 1 further comprising a plurality of pivot portions, wherein each of the plurality of shelf bottom support braces is connected to one of the plurality of pivot portions.

8. The shelf display system of claim 7 further comprising a plurality of shelf connection portions, wherein each of the plurality of pivot portions is connected to one of the plurality of shelf connection portions.

9. The shelf display system of claim 8 wherein each of the plurality of shelf connection portions is connected to a bottom surface of one of the plurality of shelves.

10. The shelf display system of claim 9 wherein each shelf connection portion is glued to the bottom surface of the one of the plurality of shelves.

11. The shelf display system of claim 1 wherein each of the front panel, first side panel, second side panel, back panel and shelf support panel are formed from a single blank of material.

12. The shelf display system of claim 11 wherein the material is corrugated paper.

13. A shelving system comprising:

a front panel having a plurality of shelves foldably connected to the front panel at a front edge of each shelf, a first side panel connected to a first side of the front panel by a fold line, a second side panel connected to a second side of the front panel by a fold line, and a back panel connected to the second side panel by a fold line;

a shelf support panel having a plurality of shelf bottom support braces extending from the back panel to the front panel wherein each brace is positioned vertically when the system is set up and is aligned with one of the plurality of shelves; and, a plurality of shelf connection portions, wherein each of the plurality of shelf connection portions connects one of the plurality of braces to a bottom surface of one of the plurality of shelves.

14. The shelving system of claim 13 wherein the shelf support panel is connected to the first side panel by a fold line.

15. The shelving system of claim 14 wherein each of the shelf bottom support braces is connected to a first pivot portion by a fold line, and wherein each first pivot portion is connected to a second pivot portion by a fold line, and each second pivot portion is connected to a shelf connection portion by a fold line.

16. The shelving system of claim 13 wherein the shelf support panel is glued to an inner surface of the back wall.

17. The shelving system of claim 16 further comprising a plurality of front connection panels wherein each front connection panel is connected to one of the plurality of shelf bottom support braces by a fold line, and wherein each front connection panel connects the one of the plurality of shelf bottom support braces to an inner surface of the front panel.

18. The shelving system of claim 17 wherein each of the front connection panels is glued to an inner surface of the front panel.

19. A shelving system comprising:

a front panel having a plurality of shelves foldably connected to the front panel at a front edge of each shelf, a first side panel connected to a first side of the front panel by a fold line, a second side panel connected to a second side of the front panel by a fold line, and a back panel connected to the second side panel by a fold line;

a shelf support panel having a plurality of shelf bottom support braces extending from the back panel to the front panel wherein each brace is positioned vertically when the system is set up and is aligned with one of the plurality of shelves, and wherein the shelf support panel is glued to an inner surface of the back wall; and, a plurality of front connection panels wherein each front connection panel is connected to one of the plurality of shelf bottom support braces by a fold line, and wherein each front connection panel connects the one of the plurality of shelf bottom support braces to an inner surface of the front panel.

20. A shelf display system comprising:

a front panel having a plurality of shelves pivotally connected to the front panel, a first side panel connected to a first side of the front panel, a second side panel connected to a second side of the front panel, and a back panel;

a shelf support panel having a plurality of shelf bottom support braces extending from the back panel to the front panel wherein each brace is aligned with one of the plurality of shelves;

a plurality of pivot portions, wherein each of the plurality of shelf bottom support braces is connected to one of the plurality of pivot portions; and, a plurality of shelf connection portions, wherein each of the plurality of pivot portions is connected to one of the plurality of shelf connection portions and wherein each of the plurality of shelf connection portions is connected to a bottom surface of one of the plurality of shelves.

21. The shelf display system of claim 20 further comprising a plurality of front connection panels wherein each front connection panel connects one of the plurality of shelf bottom support braces to an inner surface of the front panel.

22. The shelf display system of claim 21 wherein each of the plurality of front connection panels is glued to the inner surface of the front panel.

* * * * *